United States Patent [19]

Mercier et al.

[11] 4,140,239

[45] Feb. 20, 1979

[54] RE-USABLE EXPERIMENTATION CRUCIBLE

[75] Inventors: Jacques Mercier, Dardilly; André Ponthus, Villeurbanne, both of France

[73] Assignee: Societe d'Etudes d'Automatisation de Regulation et d'Appareils des Mesures, Societe Anonyme, Lyon, France

[21] Appl. No.: 908,532

[22] Filed: May 22, 1978

[30] Foreign Application Priority Data

Jun. 9, 1977 [FR] France ..... 77 18421

[51] Int. Cl.[2] ..... B65D 45/32

[52] U.S. Cl. ..... 220/319; 220/359; 215/274

[58] Field of Search ..... 220/319, 359; 215/232, 215/274

[56] References Cited

U.S. PATENT DOCUMENTS

| | | | |
|---|---|---|---|
| 1,713,224 | 5/1929 | Gunter | 220/319 X |
| 2,037,536 | 4/1936 | Richardson | 220/319 X |
| 2,725,252 | 11/1955 | Greer | 220/319 X |

*Primary Examiner*—George T. Hall
*Attorney, Agent, or Firm*—Karl F. Ross

[57] ABSTRACT

A re-usable experimentation crucible comprises a cylindrical side wall, a base, an opening, an internal support surface located adjacent and directed towards the opening, a removable stopper supported and centered on the support surface, and an annular groove located in the side wall between said support surface and the opening. A ring of plastic material may be inserted between the side wall and the stopper and driven by extrusion in the direction of the bottom of the crucible. This causes the ring to deform and fill the annular groove and ensure sealed closure of the crucible.

9 Claims, 4 Drawing Figures

RE-USABLE EXPERIMENTATION CRUCIBLE

The present invention relates to a re-usable experimentation crucible.

When making thermodynamic measurements, it is frequently necessary to experiment on substances subjected to high pressure and a high temperature.

The device which is the subject of the invention is an experimentation crucible intended for this type of measurement which, in a general manner, must be in the form of a receptacle having thick walls able to withstand high pressures and a cylindrical outer surface facilitating its introduction into the socket of a thermal fluxmeter, with good thermal connection to this socket. The purpose of the invention is to provide a crucible of this type comprising a sealed closure system which is resistant to temperature and pressure but facilitating the recovery and re-use of the crucible after an experiment and also possibly comprising arrangements for pressurizing the inside of the crucible.

To this end, the invention relates essentially to a re-usable experimentation crucible having a cylindrical side wall and a base of considerable depth, which comprises internally, adjacent its opening, a support surface facing the opening, on which a removable stopper is supported and centered and an annular groove located between the said support surface and the opening, a ring of plastic material being able to be engaged between the side wall of the crucible and the stopper and to be driven by extrusion in the direction of the bottom of the crucible, in order to fill the annular groove and ensure the sealed closure of the crucible.

After extrusion, this ring forms a tight seal between the side wall of the crucible and the stopper. Advantageously, adjacent the opening, the annular groove is defined by a step having a sharp edge, on which the material of the ring forms a pressure-resistant anchorage.

According to a particular embodiment, the stopper has two cylindrical ends of different diameters, connected by a central frustoconical part, the cylindrical part of larger diameter being supported on the said support surface whereas the frustoconical part is located opposite the bottom of the annular groove. The frustoconical part pushes the ring towards the bottom of the groove when the latter is driven by extrusion and it then ensures the retention of the stopper by a wedge effect.

The recovery of the crucible is achieved by selective chemical action or by mechanical destruction of the deformed ring, which remains accessible from outside even when it is pushed to the bottom of the annular groove.

According to another feature of the invention, a pressurization tube passes through the bottom of the crucible which tube, depending on the position in which the crucible is used, opens out in the vicinity of the stopper or the cylindrical side wall.

However, the invention will be better understood by means of the ensuing description, referring to the accompanying diagrammatic drawings illustrating, as a non-limiting example, several embodiments of this re-usable experimentation crucible:

Figure 1:
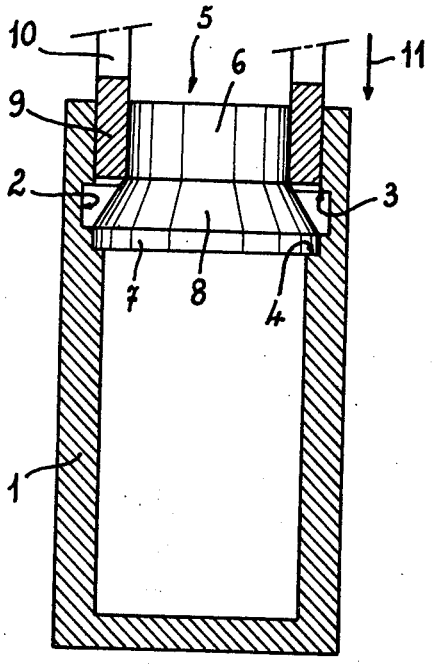
FIG. 1 is a sectional view of a crucible according to the invention, before complete closure.

The crucible 1 according to the invention has a general cylindrical shape. It has thick walls and its outer surface preferably has an absolutely constant diameter, to facilitate positioning of the crucible with slight clearance in a tube or socket.

One end of the crucible 1 is open and the inner surface of the crucible is machined, at a certain distance from this end, in order to produce an annular groove 2 defined, adjacent the opening, by a step 3 having a sharp edge.

Beyond the groove 2, the side wall of the crucible 1 has a change in diameter creating a support surface 4 in the form of a ring, directed towards the opening.

The crucible 1 is closed by a removable stopper 5 having two cylindrical ends 6 and 7 of different diameters, connected by a central frustoconical part 8. The lower cylindrical part 7 of the stopper 5, which is that having the larger diameter, is supported on the surface 4 and centered by an exact fit. The frustoconical part 8 is located opposite the bottom of the annular groove 2.

A ring 9 of initially cylindrical shape of plastic material is engaged between the side wall of the crucible 1 and the upper cylindrical part 6 of the stopper 5, under the force of a rammer 10 acting in the direction of arrow 11, as shown in FIG. 1. The outer cylindrical surface of the ring 9 has a diameter substantially equal to that of the opening in the crucible 1, whereas its inner cylindrical surface has a diameter substantially equal to that of the upper part 6 of the stopper. Thus, initially, the lower edge of the ring 9 remains at the height of the top of the frustoconical part 8 of the stopper 5.

Figure 2:
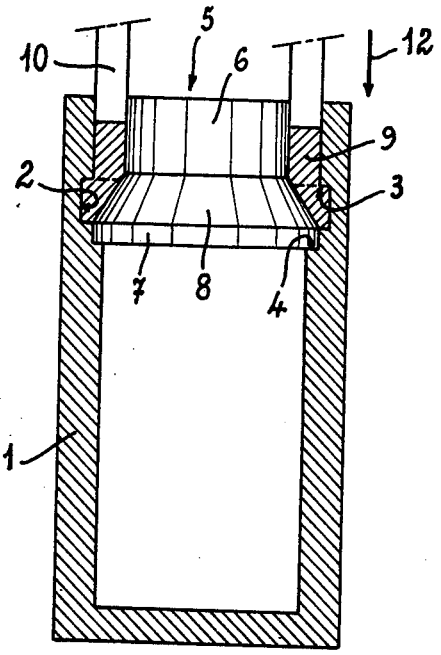
FIG. 2 is a sectional view of the same crucible, closed in a sealed manner.

Then, a considerable force or impact is exerted in the direction of arrow 12 in FIG. 2 on the rammer 10, in the direction of the bottom of the crucible 1. This force or impact drives the ring 9 which thus fills the annular groove 5 by extrusion. After extrusion, the material of the deformed ring 9 anchors said ring on the step 3 and exerts a wedging effect on the frustoconical part 8 of the stopper 5. One thus obtains a sealed closure, resistant to high pressure and temperature.

It is possible to recover the crucible 1 after an experiment has been carried out, for example by selectively dissolving the material of the ring 9, which differs from the materials constituting the crucible 1 and stopper 5 which must not be deformed during the closing operation. For example, the ring 9 is made of copper or aluminium and the crucible 1 of stainless steel, the ring being dissolved with dilute hydrochloric acid or soda. It is also possible to extract the deformed ring 9 by mechanical action, in particular by a coring operation.

Figure 3:
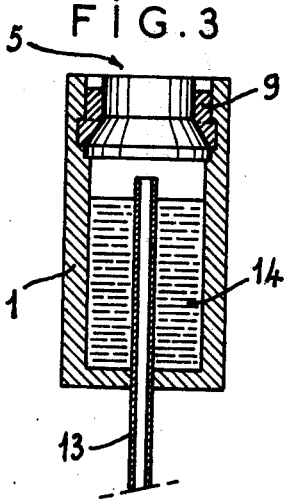
FIG. 3 is a sectional view of another embodiment of this crucible, provided with a pressurization tube passing through its base.

FIG. 3 shows a crucible 1 constructed as aforedescribed as regards the stopper 5 and ring 9 and provided with a pressurization tube 13 passing through the bottom, to which it is welded and opening out in the vicinity of the stopper 5. It is possible to introduce a liquid 14 into the crucible 1 held vertically, without it being able to escape through the tube 13.

Figure 4:
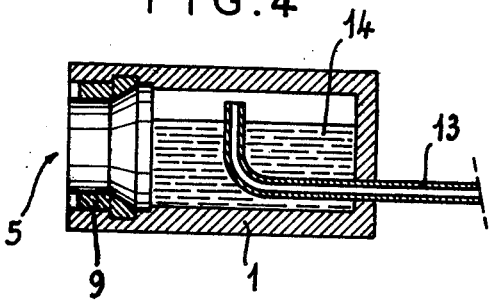
FIG. 4 is a sectional view of a variation of this crucible comprising a pressurization tube.

FIG. 4 illustrates a variation of this application of the invention, in which the crucible 1 is used in the horizontal position. The tube 13 which passes through the bottom of the crucible 1 is bent and opens out close to the side wall of the crucible, above the level of the liquid 14.

Naturally, the invention is not limited to the embodiments of this re-usable experimentation crucible which has been described by way of example. On the contrary, it includes all variations of construction and application comprising equivalent arrangements.

What is claimed is:

1. A re-usable experimentation crucible comprising a cylindrical side wall, a base, an opening, an internal support surface located adjacent and directed towards said opening, a removable stopper supported and centered on said support surface, an annular groove located in said side wall between said support surface and said opening, and a ring of plastic material engageable between said side wall and said stopper and drivable by extrusion in the direction of the bottom of the crucible, in order to fill said annular groove and ensure sealed closure of the crucible.

2. A re-usable experimentation crucible according to claim 1, in which said annular groove is defined, adjacent said opening, by a step having a sharp edge.

3. A re-usable experimentation crucible according to claim 1 or 2, in which said stopper has two cylindrical ends of different diameters connected by a central frustoconical part, said cylindrical part of larger diameter being supported on the said support surface, whereas said frustoconical part is located opposite the bottom of said annular groove.

4. A re-usable experimentation crucible according to claim 3, in which said ring of plastic material has an initially cylindrical shape, its outer surface having a diameter substantially equal to that of said opening in the crucible, whereas its inner surface has a diameter substantially equal to that of said cylindrical part of smaller diameter of said stopper.

5. A re-usable experimentation crucible according to claim 1 or 2, in which said ring is made from plastic material which is dissolvable by selective chemical action in order to recover the crucible.

6. A re-usable experimentation crucible according to claim 1 or 2, in which said ring is made from plastic material which is extractable by mechanical action.

7. A re-usable experimentation crucible according to claim 1 or 2, in which a pressurization tube passes through said base.

8. A re-usable experimentation crucible according to claim 7, in which said tube opens out in the vicinity of said stopper.

9. A re-usable experimentation crucible according to claim 7, in which said tube is bent and opens out close to said cylindrical side wall.

* * * * *